US005810492A

United States Patent [19]

Akahane et al.

[11] Patent Number: 5,810,492

[45] Date of Patent: Sep. 22, 1998

[54] PRINTER AND PRINT START METHOD THEREFORE

[75] Inventors: Takashi Akahane; Shigeki Hayashi, both of Nagano, Japan

[73] Assignee: Seiko Epson Corporation, Tokyo, Japan

[21] Appl. No.: 652,003

[22] Filed: May 23, 1996

[30] Foreign Application Priority Data

May 24, 1995 [JP] Japan ..... 7-149640

[51] Int. Cl.[6] ..... B41J 11/42

[52] U.S. Cl. ..... 400/582; 400/624; 400/708

[58] Field of Search ..... 400/605, 624, 400/629, 582, 596, 708

[56] References Cited

U.S. PATENT DOCUMENTS

| | | | |
|---|---|---|---|
| 5,035,413 | 7/1991 | Yamada et al. | 400/624 |
| 5,107,279 | 4/1992 | Yamamoto et al. | 346/108 |
| 5,223,939 | 6/1993 | Imaizumi et al. | 358/296 |
| 5,246,224 | 9/1993 | Matsuno et al. . | |
| 5,508,811 | 4/1996 | Abe et al. | 358/296 |

FOREIGN PATENT DOCUMENTS

| | | |
|---|---|---|
| 0 518 255 A2 | 12/1992 | European Pat. Off. . |
| WO 92/19453 | 11/1992 | WIPO . |

OTHER PUBLICATIONS

700 IBM Technical Disclosure Bulletin 29 (1987) May, No. 12, Armonk, New York, USA.

French Search Report.

*Primary Examiner*—John S. Hilten

*Attorney, Agent, or Firm*—Stroock & Stroock & Lavan LLP

[57] ABSTRACT

A printer and a print start method for a printer allows printing to be started at a desired position reliably even if the sheet to be printed upon is shorter than a standard length. The print start method includes determining the relative size of the sheet to be printed upon and then starting a print operation on a sheet by a print head after a sheet feed roller has released the sheet to be printed upon if the sheet being printed upon has a relatively long or standard length, and starting a print operation on a sheet by a print head before the sheet feed roller has released the sheet to be printed upon if the sheet being printed upon has a relatively short length.

12 Claims, 7 Drawing Sheets

9

PRINTER AND PRINT START METHOD THEREFORE

BACKGROUND OF THE INVENTION

1. Field of the invention

The invention relates to a print start method for a printer. More specifically, the invention is directed to a print start method in which printing can be started at a desired position even if a sheet to be printed upon is shorter than a standard length.

2. Related art

A printer known in the art as is shown in FIG. 6(*a*), has a sheet feed tray 1, a sheet feed roller 2, a sheet forward roller 3, and a print head 4 (hereinafter "head 4"). Sheet feed tray 1 is dimensioned to accommodate a plurality of individual sheets of paper or other print media P stacked up upon each other forming a plurality of sheets PS which are printed upon. An edge guide la guides a side edge of the plurality of sheets PS.

Sheet feed roller 2 has a D-shaped cross section including a straight face 2*a* and an arcuate face 2*b*. Sheet feed roller 2 feeds the uppermost sheet P out of the plurality of sheets PS accommodated in tray 1 by rotating so that arcuate face 2*b* of sheet feed roller 2 comes into contact with uppermost sheet P.

Sheet forward roller 3 receives and further forwards sheet P fed by sheet feed roller 2, sheet P reaching sheet forward roller 3 before sheet feed roller 2 releases sheet P. A pinch roller 3*a* is maintained in pressured rolling contact with sheet forward roller 3, and is designed to maintain sheet P in pressure contact with sheet forward roller 3. Print head 4 is located downstream of sheet forward roller 3 in the sheet feed direction and is positioned and designed to print data or the like on the sheet being forwarded.

A conventional print operation employing the thus constructed printer is performed as follows.

(a) When the printer is in a standby mode, sheet feed roller 2 is not in operation and therefore does not rotate and remains stationary as shown in FIG. 6(*a*). Straight face 2*a* of sheet feed roller 2 opposes sheet P on sheet feed tray 1.

(b) Upon generation of a sheet feed command signal from a sequence circuit of the printer, sheet feed roller 2 rotates in the direction indicated by arrow A in FIG. 6(*b*) so that sheet P is fed in the direction indicated by arrow B and toward sheet forward roller 3 in FIG. 6(*b*). When this rotation of sheet feed roller 2 begins, sheet forward roller rotates in the direction indicated by arrow C in FIG. 6(*b*). Thus, sheet P is fed toward sheet forward roller 3 which is rotating in the direction opposing the sheet feed direction or opposite the direction indicated by arrow B in FIG. 6(*b*).

(c) As shown in FIG. 6(*c*), when the front end Pa of sheet P reaches a nip area 3*b* formed by sheet forward roller 3 and the pinch roller 3*a* that are rotating in the direction opposing the paper feed direction, the passage of sheet P between sheet forward roller 3 and pinch roller 3*a* is blocked. This blocking causes the sheet P to flex, and a restitutive force resulting therefrom biases front end Pa of sheet P onto nip section 3*b* between sheet forward roller 3 and pinch roller 3*a*, thereby correcting the position of sheet P if sheet P is forwarded obliquely. Thus, any skew of sheet P generated during feeding can be eliminated.

(d) After sheet P has been flexed as is shown in FIG. 6(*c*), sheet forward roller 3 then rotates in the direction indicated by arrow D in FIG. 6(*d*), thereby forwarding front end Pa of sheet P in the direction indicated by arrow B in FIG. 6(*d*). During this forwarding of front Pa of sheet P, sheet feed roller 2 is maintained in a stationary position. Thus, the rotation of sheet forward roller 3 unflexes sheet P.

(e) As shown in FIG. 6(*e*), after sheet P is fully unflexed, both sheet feed roller 2 and sheet forward roller 3 are further rotated in the directions indicated by arrows A and D respectively until sheet feed roller 2 makes a full rotation (until straight face 2*a* of sheet feed roller 2 is opposing sheet P and sheet feed roller 2 is no longer maintained in contact with sheet P). As a result of this rotation, front edge Pa of sheet P will be forwarded past the position of head 4.

(f) As shown in FIG. 6(*f*), sheet P is fed in the reverse direction, indicated by arrow E in FIG. 6(*f*) by reversely rotating sheet forward roller 3 in the direction indicated by arrow C in FIG. 6(*f*), and front end Pa of sheet P is thereafter properly positioned at a predetermined location with respect to head 4. Then, printing is started as sheet P passes below head 4 and is fed in the paper feed direction.

Printing is not started when sheet P reaches the location as shown in FIG. 6(*d*) because variations in the sheet feed distance caused by mechanical errors and the like of sheet feed roller 2 and of the drive system of sheet feed roller 2 may slightly affect the sheet forward distance, the exact positioning of sheet P, and the amount of rotation of sheet forward roller 3, which in turn may impair print quality and may vary the area of sheet P which is printed upon.

Thus, by rotating both sheet feed roller 2 and sheet forward roller 3 so that sheet P is forwarded past head 4 (see FIG. 6(*e*)) until sheet feed roller 2 makes almost a full rotation and sheet P is no longer maintained in contact with sheet feed roller 2, and thereafter rotating sheet forward roller 3 in the direction opposing the sheet feed direction, front end Pa of sheet P is properly positioned with respect to the head 4 so that printing may properly begin.

While this printing scheme has been satisfactory, a number of problems result if a sheet of paper to be printed upon is shorter in the paper feed direction than a standard size. Specifically, as is shown in FIG. 7, if a sheet to be printed upon PH is a short sheet having a length less than a standard length, such as a postcard, for example, during the feeding of sheet PH in the paper feed direction until straight face 2*a* of sheet feed roller 2 opposes sheet P as shown in FIG. 6(*d*), a tail end PHb of sheet PH will be forwarded past a front edge 1*b* of edge guide 1*a*. Thereafter, upon the feeding of sheet P in the direction opposite to the paper feed direction (arrow F in FIG. 7), it is possible for a tail end PHb to come into contact with front edge 1*b* of edge guide 1*a*. Thus, sheet P would no longer be able to be moved in the direction opposite to the paper feed direction (arrow F), which in turn would prevent front end PHa of sheet PH from being properly positioned with respect to head 4. As a result, printing cannot be started at the proper predesigned position. Print quality may suffer, and the portion of sheet PH to be printed upon may vary.

Further, as shown in FIG. 8, if a sheet feed tray 1' is inclined with respect to the paper feed path, and if sheet PH is forwarded substantially horizontally by the sheet forward roller 3 in the sheet forward direction, then at the time sheet PH is fed in the direction opposite the sheet feed direction, indicated by arrow G in FIG. 8, tail end PHb may come into contact with a surface PH2' of a second sheet PH2 positioned on sheet feed tray 1'. Because of resistance between tail end PHb of sheet PH and surface PH2' of second sheet PH2, front end PHa of sheet PH may not be able to be properly positioned with respect to head 4. As a result, printing will not be started at the proper desired position.

Thus, it is desired to provide a print start method for a printer in which printing can be reliably started at a desired position even if a short sheet is to be printed upon.

SUMMARY OF THE INVENTION

Generally speaking, in accordance with the invention a print start method for a printer is provided and is applied to a printer having a sheet feed roller, a sheet forward roller, and a print head. The sheet feed roller has a D-shaped cross section including a straight face and an arcuate face, the arcuate face initially positioned opposing a sheet to be printed upon. The sheet feed roller feeds the sheet to be printed upon by rotating in a first direction so as to cause the arcuate face thereof to come into contact with the sheet. A sheet forward roller is positioned downstream from the sheet feed roller in the sheet feed direction and is position to forward the sheet fed by the sheet feed roller while coming in contact with the sheet while the sheet feed roller still maintains contact with the sheet. The print head is located downstream of the sheet feed roller in the sheet feed direction and prints data on the sheet. The method includes determining whether a long sheet or a short sheet is to be printed and starting a print operation with the print head after the contact of the sheet feed roller with the sheet has been released if the sheet used for printing is relatively long; and starting a print operation with the print head even before the contact of the sheet feed roller with the sheet is released if the sheet used for printing is relatively short.

If a sheet to be printed upon is a relatively long sheet, printing thereon is started by the print head after the contact of the sheet feed roller with the sheet has been released. Therefore, the print start method is free from variations in the sheet feed distance caused by mechanical errors and the like of the sheet feed roller and of the drive system of the sheet feed roller, which in turn ensures high quality printing.

However, if a sheet to be printed upon is a relatively short sheet, printing thereon is started by the print head even before the contact of the sheet feed roller with the sheet is released, as is shown in FIG. 6(*d*). Therefore, the method allows the head end of the sheet to be positioned with respect to the head without feeding the sheet backward.

Hence, the print operation can be reliably started at a desired position.

Accordingly, it is an object of the invention is to provide a print start method for a printer in which printing can be reliably started at a desired position.

Another object of the invention is to provide a print start method for a printer in which printing can be reliably started at a desired position even if a short sheet is to be printed upon.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
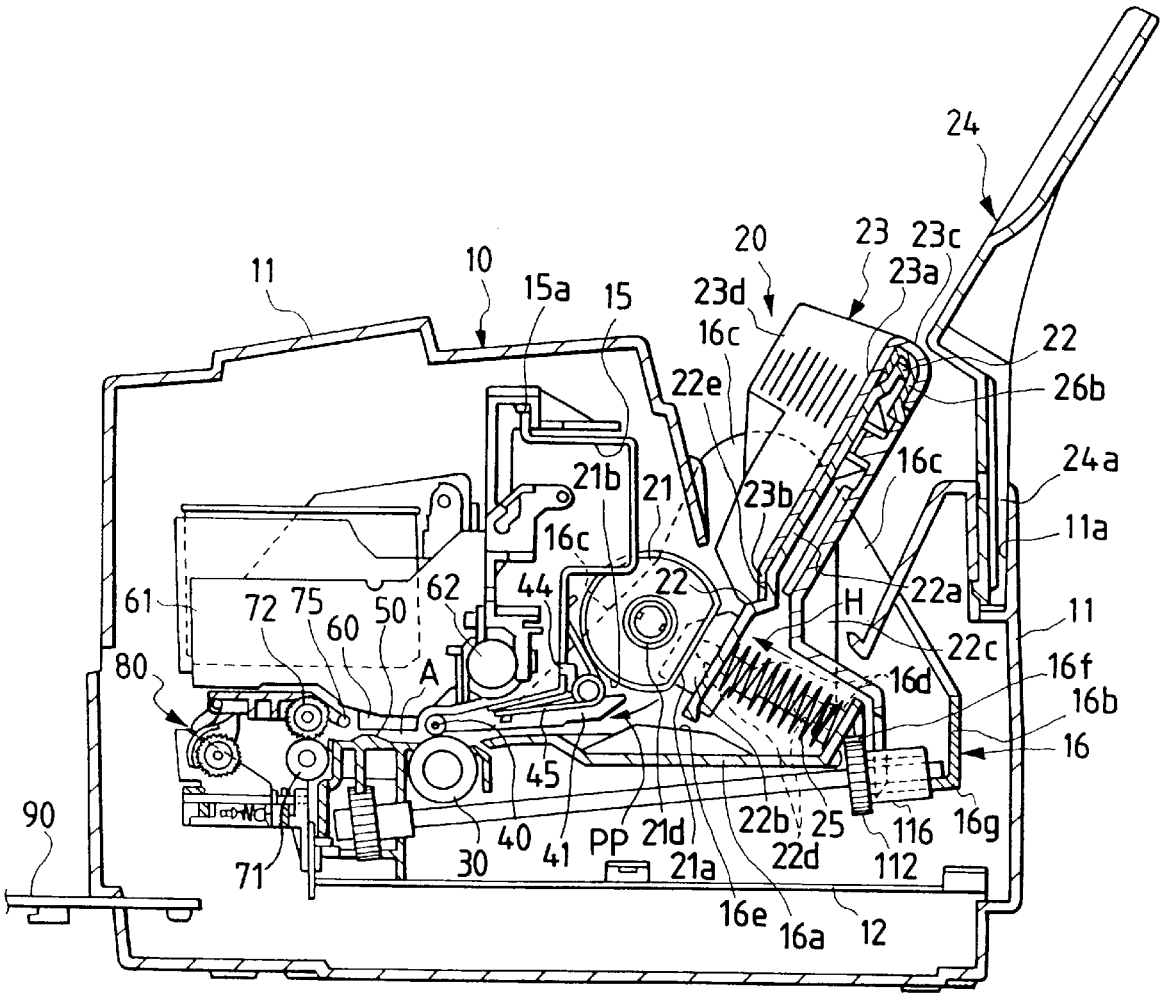
FIG. 1 is a side cross-sectional view of a printer to which a print start method of the invention is applied.

Reference is first made to FIG. 1, in which a printer main body 10 is formed with a case 11 and an automatic sheet feeder 20 incorporated within main body 10.

Referring next to FIG. 4 in addition to FIG. 1, a sheet feed path PP, through which a sheet of paper P fed by automatic sheet feeder 20 passes, is shown. At least one sheet forward roller 30 is mounted within printer body 10 downstream of automatic sheet feeder 20 along sheet feed path PP. A pinch roller 40 is maintained in pressure contact with sheet forward roller 30 and is driven to rotate thereby. A regulating member 50 adapted to guide a back end of sheet P is disposed downstream of rollers 30, 40 along sheet feed path PP. A carriage 61 is supported within casing 11 and supports an ink jet head 60 and the like mounted thereon to perform a print operation by ejecting ink droplets onto a sheet P. A guide roller 75 positioned downstream of ink jet head 60 guides sheet P along sheet feed path PP. A pair of sheet discharge rollers 71, 72 are disposed between guide roller 75 and a sheet discharge section 80. Further, fixed to a front of main body 10 a sheet discharge tray 90 is provided on which discharged sheets are stacked after they have been printed upon.

Figure 2:
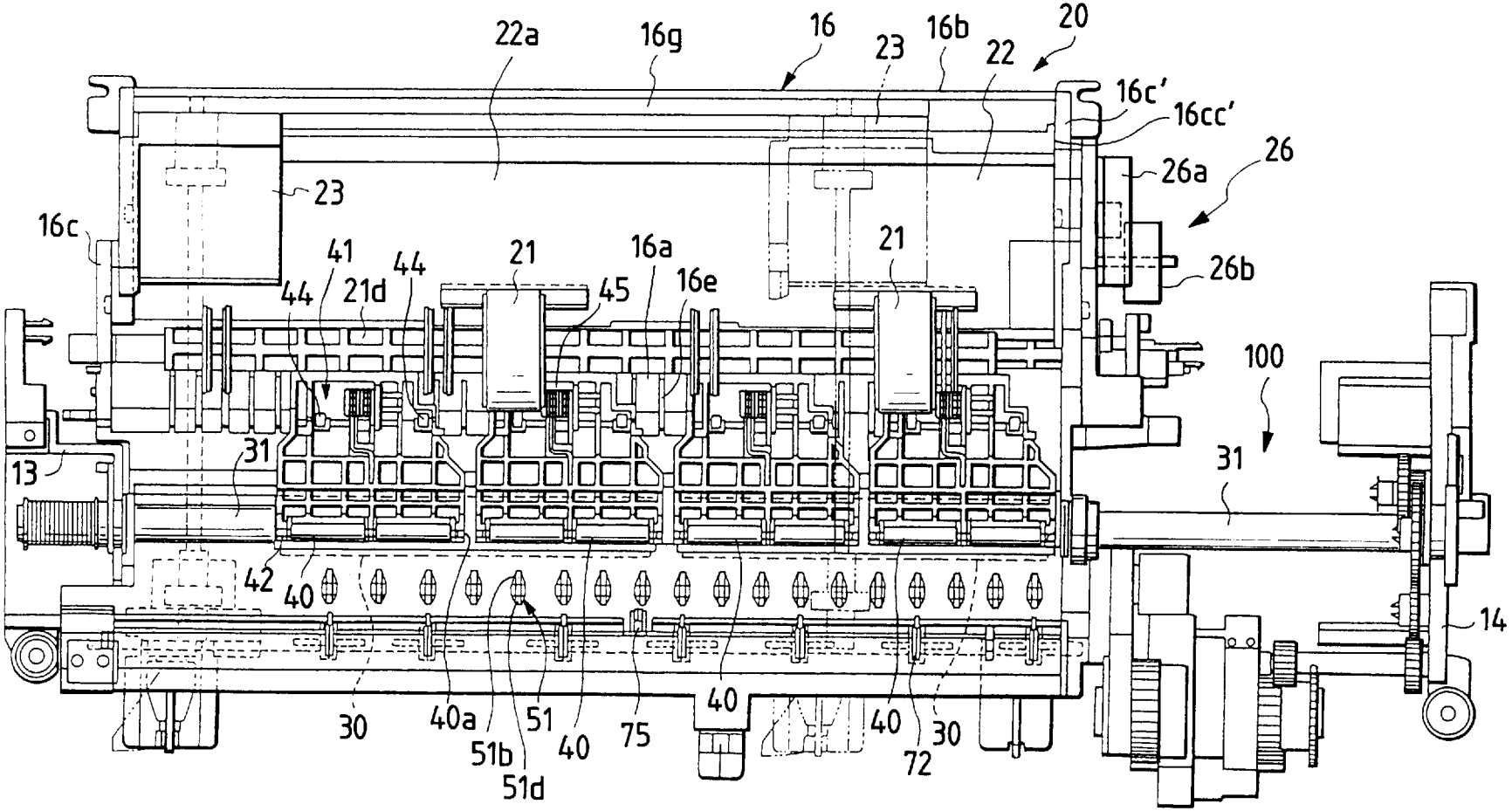
FIG. 2 is a partial top plan view of the printer of FIG. 1.

Referring next to FIGS. 1 and 2, details of automatic sheet feeder 20, sheet forward roller 30, and pinch roller 40 will be described. Main body 10 is formed with a bottom frame 12, side frames 13, 14, an intermediate frame 15, and a subframe 16 within case 11. In a preferred embodiment, bottom frame 12 is formed of a metal plate and serves also as a shield plate inside casing 11. Right and left side frames 13, 14, which are formed of plastic, are positioned adjacent the left and right sides of the bottom frame 12 and extend orthogonally thereto. Intermediate frame 15 bridges between side frames 13, 14 and is formed of a metal plate. Subframe 16 is formed of plastic, is secured to frames 13, 14 and is dimensioned to allow many of the internal components of the printer to be fixed thereto.

Subframe 16 further includes a bottom plate 16*a*, a back plate 16*b*, and side plates 16*c*, 16*c*'. Bottom plate 16*a* forms a lower portion of sheet path PP. Back plate 16*b* is formed integrally with bottom plate 16*a* at a back edge thereof. Side plates 16*c*, 16*c*' are also formed integrally with bottom plate 16*a* and with back plate 16*b* at each end thereof. Thus, bottom plate 16*a*, back plate 16*b*, and side plates 16*c*, 16*c*' are all formed integrally with each other. A rib-like sheet guide 16*e* is formed on a top surface of bottom plate 16*a*.

Figure 3:
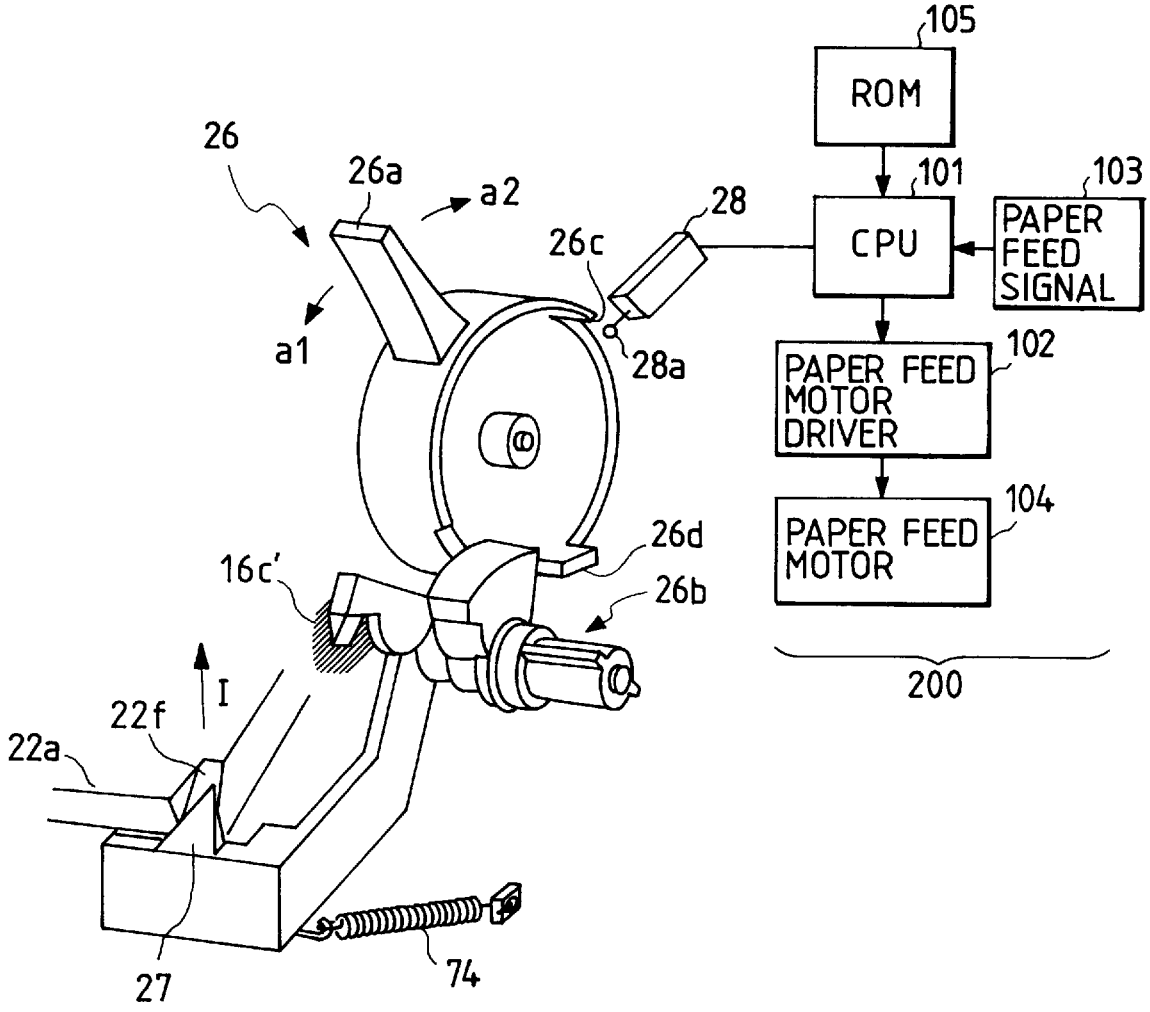
FIG. 3 is a perspective view of a sheet length detection and feed control mechanism constructed in accordance with the invention.
Figure 4A:
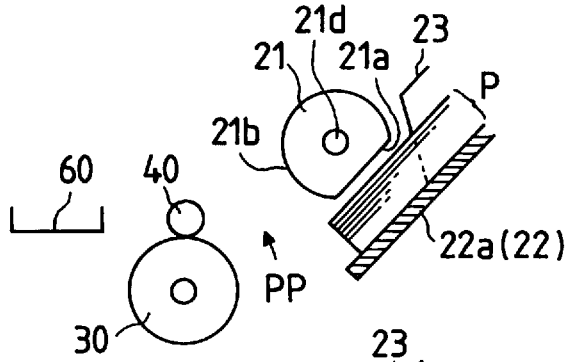
FIGS. 4(*a*)–4(*e*) depict the method of feeding a sheet in a printer in accordance with the invention.
Figure 4B:
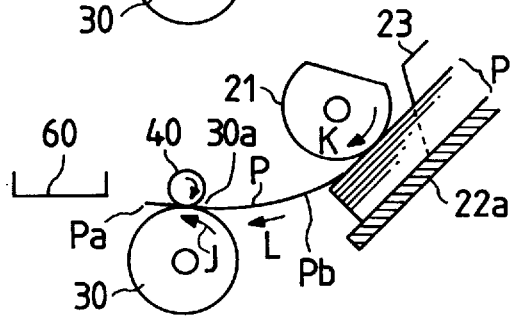
Figure 4C:
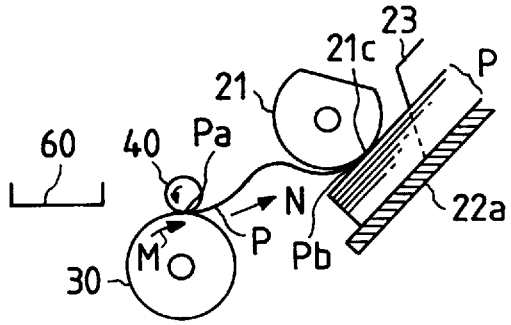
Figure 4D:
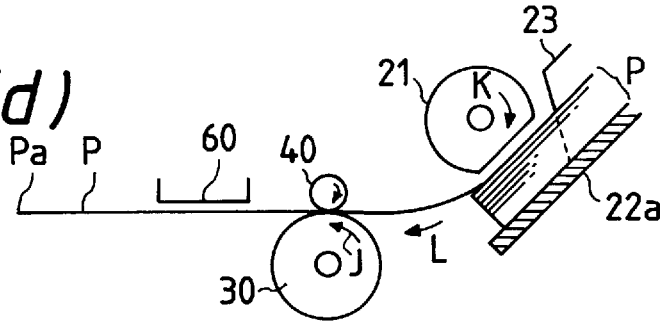
Figure 4E:
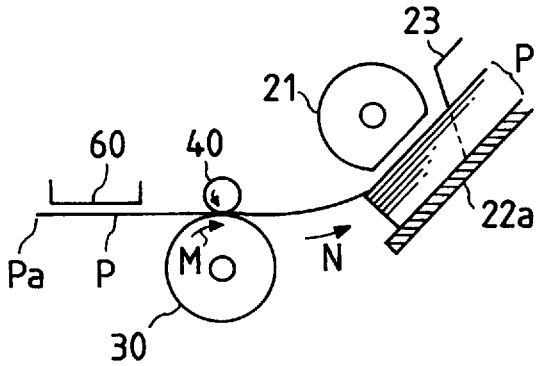

Automatic sheet feeder 20 is also formed with a hopper 22, an edge guide 23, a sheet feed tray 24, and a separation pawl retracting mechanism 26 (see FIG. 3). A grooved sheet feed roller shaft 21*d* is rotatably supported by side plates 16*c*, 16*c*' of subframe 16. Sheet feed rollers 21 are fixedly mounted on sheet feed roller shaft 21*d*. Each sheet feed roller 21 is formed with a D-shaped cross-section that includes a straight face 21*a* and an arcuate face 21*b* and is further formed with a rubber-coated surface. Sheet feed roller shaft 21*d* is driven to rotate by a transmission mechanism (not shown) that interlocks with a drive mechanism 100 during sheet feed operation.

As shown in FIGS. 4(*a*) and (*b*), sheet P is fed by automatic sheet feeder 20 and contacts sheet forward roller 30 along sheet feed path PP. Sheet feed path PP is concavely curved as viewed in FIGS. 1 and 4. Sheet P is further forwarded by sheet forward roller 30 with the angle of forwarding of sheet P being regulated by the positioning of pinch roller 40. Thus sheet P has its front end Pa and its back end Pb guided by regulating member 50 while essentially at all times being in contact with the upper surface of regulating member 50. Regulating member 50 also acts as a guide member so that the distance between the sheet P and ink jet head 60 is maintained at a constant, predetermined value. As a result, ink is properly ejected from head 60 onto a front surface of sheet P. Sheet P, after being printed upon, is then discharged onto a sheet discharge tray 90 via the pair of sheet feed rollers 71, 72 and a sheet discharge section 80.

One side of hopper 22 is shown in FIG. 1, the other side being a mirror image thereof. Hopper 22 is formed of a bottom plate 22*a*, side plates 22*b*, 22*b* (only one shown in FIG. 1), triangular side plates 22*c*, 22*c* (only one shown in FIG. 1), and pins 22*d*, 22*d*. Bottom plate 22*a* supports the bottom surface of sheet P. Side plates 22*b* are formed integrally with bottom plate 22*a* so as to extend upward on both left and right sides of bottom plate 22*a*. Triangular side plates 22*c*, 22*c* are also formed integrally with bottom plate 22*a* so as to extend downward on both left and right sides of bottom plate 22*a*. Pins 22*d*, 22*d* project sideways and are formed integral with side plates 22*b*, 22*c*. Pins 22*d*, 22*d* engage a pair of elongated holes 16*d*, 16*d* formed in side plate 16*c* of subframe 16, to allow hopper 22 to be mounted so as to be movable in an oblique direction along edge guide 23, indicated by arrow H in FIG. 1 with respect to subframe 16. Between hopper 22 and bottom plate 16*a* of subframe 16 is a hopper spring 25. Hopper spring 25 biases hopper 22 obliquely in the direction indicated by arrow H in FIG. 1. A hopper spring 25 is positioned at locations corresponding to the location of each sheet feed roller 21. A cam mechanism (not shown) that interlocks with drive mechanism 100 is mounted on and below side plates 16*c*, 16*c*' of subframe 16. The cam mechanism is designed to hold hopper 22 against the elastic forces of hopper springs 25. Hopper 22 is designed to release sheet P when straight face 21*a* of sheet feed roller 21 opposes it. That is, during a sheet feed operation, the holding force generated by the cam mechanism on hopper 22 is released, hopper 22 is urged in the direction indicated by arrow H in FIG. 1 and sheet P is pushed up by the pressure of hopper springs 25 so as to be biased onto sheet feed rollers 21. When a sheet feed operation is completed the holding force of the cam mechanism is restored and hopper 22 is pressed in the direction opposite to that of arrow H in FIG. 1 by the cam mechanism so that sheet P is no longer maintained in contact with sheet feed rollers 21.

Edge guide 23 is further formed with a bottom plate 23*a*, a bent portion 23*b* arranged on the front end portion of bottom plate 23*a*, a clip portion 23*c* arranged on the rear end portion of bottom plate 23*a*, and a side plate 23*d*. Edge guide 23 is slidably mounted so as to be slidable with respect to hopper 22. Bent portion 23*b* is engaged with a groove 22*e* of hopper 22. Clip portion 23*c* resiliently clamps the rear portion (the upper end portion as shown in FIG. 1) of hopper 22 so as to enclose this rear portion. Edge guide 23 serves to guide the left side of a sheet P (not shown) set on hopper 22 in FIG. 2. The right side of sheet P is guided by an inner side surface 16*cc*' of side plate 16*c*' on the right side of subframe 16.

As shown in FIG. 1, sheet feed tray 24 is releasably mounted on main body 10 by inserting an insertion piece 24*a* formed on the lower portion of sheet feed tray 24 into an insertion hole 11*a* formed in case 11 of main body 10 so that sheet feed tray 24 is detachably mounted on printer body 10. Sheet feed tray 24 is designed to support the bottom surface of sheet P in cooperation with hopper 22 when mounted on the main body 10.

Reference is now made to FIG. 3, which depicts separation pawl retracting mechanism 26 mounted on side plate 16*c*' of subframe 16. Retracting mechanism 26 includes a lever 26*a* rotatably mounted to side plate 16*c*' and rotatable between a first direction as shown by arrow al and a second direction as shown by a2. Lever 26*a* includes a contact surface 26*c*, and a caming surfacing 26*d*. An interlock mechanism 26*b* mounted on side frame 16*c*' operatively couples lever 26*a* and a separating pawl 27. Separating pawl 27 separates sheets from a stack placed on bottom plate 22*a*.

Retracting mechanism 26 is designed to project a separation pawl 27 from bottom plate 22*a* of hopper 22 in the direction indicated by arrow I in FIG. 3. A recess 22*f* is formed in bottom plate 22*a* to receive separation pawl 27 when it is not projected. A spring 74 biases pawl 27 into recess 22*f*. When a lever 26*a* is rotated in a direction indicated by an arrow al in FIG. 3, caming surface 26*d* activates interlocking mechanism 26*b* so that separation pawl 27 projects from bottom plate 22*a* of hopper 22 in the direction indicated by arrow I in FIG. 3. When lever 26*a* is turned in a direction indicated by an arrow a2 in FIG. 3, separation pawl 27 returns to recess 22*f* through spring 74. Thus, separation pawl 27 is selectively moveable between a first position projecting from bottom plate 22*a* of hopper 22 and a second position within recess 22*f*.

When separation pawl 27 is in its first position, separation pawl 27 is located above a thin sheet P retained in hopper 22. During a sheet feed operation, one sheet P may be separated from a plurality of sheets P by the action of separation pawl 27. Further, when separation pawl 27 is accommodated in recess 22*f* in its second position, a relatively thick single sheet, such as a postcard, may be separated from a plurality of sheets with the front end thereof coming in contact with bottom plate 16*a* of subframe 16 shown in FIG. 1 at the time this thick sheet is fed.

Therefore, lever 26*a* is rotated in the direction indicated by arrow al by the user when an ordinary sheet or the like is retained in the automatic sheet feeder 20, whereas lever 26*a* is rotated in the direction indicated by arrow a2 when a short sheet such as a postcard or the like is set.

Reference numeral 28 denotes a detector, which detects whether lever 26*a* has been rotated in the direction indicated by arrow al or a2 in FIG. 3. That is, as lever 26*a* is rotated contact surface 26*c* contacts and operates switch 28*a* of detector 28 so that detector 28 determines whether an ordinary sheet or the like or whether a thicker and shorter sheet, such as a postcard or the like is retained in automatic sheet feeder 20. Detector 28 is electrically coupled with a processor 200. CPU 101 of processor 200 operates a paper feed motor feed driver 102 and paper feed motor 104 in response to inputs from detector 28. Paper feed motor 104 is coupled to at least one of sheet forward rollers 30 and sheet feed roller 21. CPU 101 contains the required programming steps in ROM 105. Upon detection of the type of sheet to be forwarded, a particular sheet feed program is read from ROM 105. Thereafter, paper feed motor driver 102 drives paper feed motor 104 according to the method of the invention depending on the type of sheet to be forwarded.

It is relatively easy to place a plurality of sheets PS onto sheet feeder 20. Since hopper 22 is pressed down against the bias force of spring 25 by the holding force of the cam mechanism, the plurality of sheets PS may be easily placed within sheet feeder 20 when automatic sheet feeder 20 is not in operation by placing a plurality of sheets PS into the hopper from above. When automatic sheet feeder 20 is operated and a plurality of sheets PS are set therein, hopper 22 is first elevated when the holding force of the cam mechanism is released. This allows the uppermost sheet P of the plurality of sheets PS piled up in hopper 22 to be fed into sheet feed path PP upon coming in contact with, and being urged by sheet feed roller 21.

As shown in FIG. 2, sheet forward roller 30 is constructed of two relatively elongated round rodlike rubber roller portions that are coaxially fixed to a sheet forward roller shaft 31. Sheet forward roller shaft 31 is supported between side frames 13, 14, and is driven to rotate by drive mechanism 100 under the control of CPU 101. Sheet forward roller 30 forwards a sheet P, as will be described below, and comes into contact with sheet P fed by sheet feed roller 21 before sheet feed roller 21 releases sheet P during the sheet feed operation. Sheet P is thereafter forwarded a predetermined distance after a print operation has been performed by head 60.

Four pinch rollers 40, each being constructed of a round rodlike roller portion, preferably made of metal, are arranged opposing each sheet forward roller 30. Each pinch roller 40 has a shaft 40*a* formed on each end thereof, each shaft 40*a* being rotatably supported by an arm portion 42 of a holder 41. Holder 41 also serves as a sheet guide and forms the upper portion of sheet path PP. As shown in FIGS. 1 and 2, a pair of hooks 44 is arranged on top of holder 41. Pair of hooks 44 suspends holder 41 so as to be oscillatable with respect to intermediate frame 15. A spring is situated between holder 41 and intermediate frame 15. The biasing force of spring 45 urges spring 45 to be maintained in contact with sheet forward roller 30.

The print start method according to this embodiment involves the following operation in the thus constructed printer.

In the case where a relatively long sheet P, such as an ordinary sheet P, is set in the automatic sheet feeder, lever 26*a* is rotated in the direction of arrow al so that this condition is detected by detector 28. Control section 200 operates various parts of the printer in the following way, as shown in FIGS. 4(*a*)–(*e*).

(a) In a standby condition, sheet feed roller 21 is not in operation as shown in FIG. 4(*a*). Straight face 21*a* of sheet feed roller 21 confronts a sheet P on hopper 22.

(b) Upon output of a sheet feed command signal from control section 200 of the printer, sheet forward roller 30 rotates in the sheet forward direction indicated by arrow J in FIG. 4(*b*), and sheet feed roller 21 rotates in the direction by arrow K in FIG. 4(*b*) so that sheet P is fed toward sheet forward roller 30 in the direction indicated by arrow L in FIG. 4(*b*). This sheet feed operation is continued until head end Pa of sheet P reaches nip area 30*a* between sheet forward roller 30 and pinch roller 40.

(c) Next, as shown in FIG. 4(*c*), sheet feed roller 21 stops rotating, and sheet forward roller 30 rotates in the reverse direction, indicated by arrow M in FIG. 4(*c*) and thereby pushes head end Pa of sheet P backward in the direction indicated by arrow N in FIG. 4(*c*).

Even if sheet P is forwarded past nip area 30*a* between sheet forward roller 30 and pinch roller 40 with the head end Pa of sheet P skewed, sheet feed roller 21 resists the movement of sheet P in the direction indicated by arrow N in FIG. 4(*c*) at the contact portion 21*c* between sheet P and sheet feed roller 21 when sheet P is fed in the direction indicated by arrow N in FIG. 4(*c*) by sheet forward roller 31. Therefore, head end Pa of sheet P is correctly positioned at nip area 30*a* between sheet forward roller 30 and pinch roller 40. Thus, any skew of sheet P is eliminated.

(d) As shown in FIG. 4(*d*), next both sheet feed roller 21 and sheet forward roller 30 are rotated respectively in the direction indicated by arrows K and J in FIG. 4(*d*) until sheet feed roller 21 makes a full rotation. At this time, straight face 21*a* will be facing sheets P, and will not be in contact therewith. As a result, sheet P is fed in the direction indicated by arrow L in FIG. 4(*d*) and head end Pa thereof moves past head 60 position. It may be noted that a single rotation of sheet feed roller 21 is made by a single-rotation clutch arranged in the transmission mechanism (not shown) that interlocks with drive mechanism 100.

(e) As shown in FIG. 4(*e*), sheet forward roller 30 is next rotated in the direction indicated by arrow M to feed sheet P in the direction indicated by arrow N to thereby properly position head end Pa of sheet P with respect to head 60. Thereafter, a print operation is commenced.

According to this print start method, a sheet feed roller 21 and sheet forward roller 30 rotate until sheet feed roller 21 makes a complete rotation so that the sheet P is forwarded past head 60 (see FIG. 4(*d*)). Sheet forward roller 30 next rotates in the reverse direction to allow head end Pa of sheet P to be properly positioned with respect to head 60 so that a print operation can thereafter begin. Therefore, the positioning of head end Pa is free from variations in the sheet feed distance which may be caused by mechanical errors and the like of sheet feed roller 21 and of driving system 100 of sheet feed roller 21. Hence, high quality printing can be obtained.

Figure 5A:
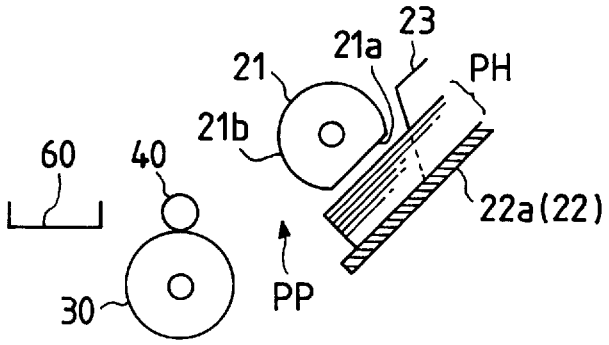
FIGS. 5(*a*)–5(*c*) depict the method of feeding in accordance with the invention.
Figure 5B:
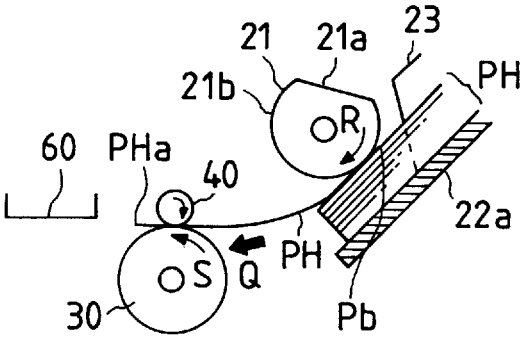
Figure 5C:
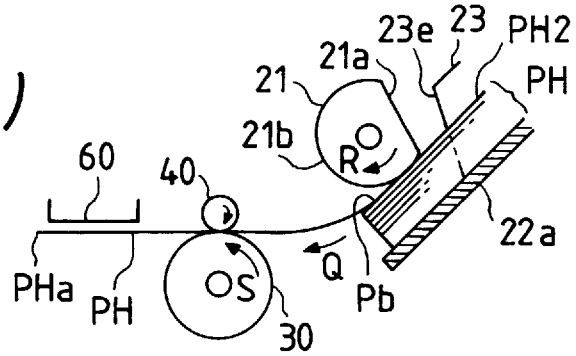
Figure 6A:
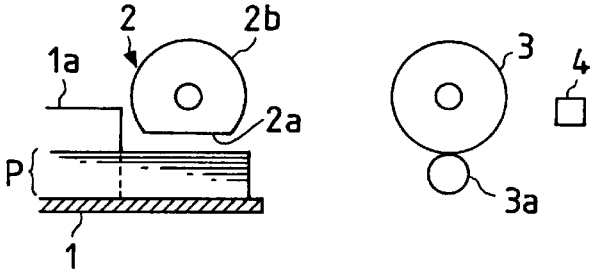
FIG. 6(a) PRIOR ART
FIGS. 6(*a*)–6(*f*) depict the operation of a prior art feed method.
Figure 6B:
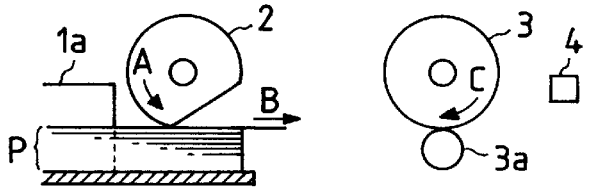
FIG. 6(b) PRIOR ART
Figure 6C:
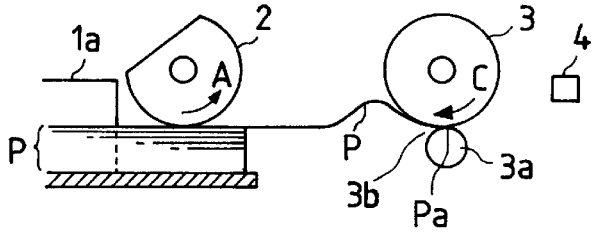
FIG. 6(c) PRIOR ART
Figure 6D:
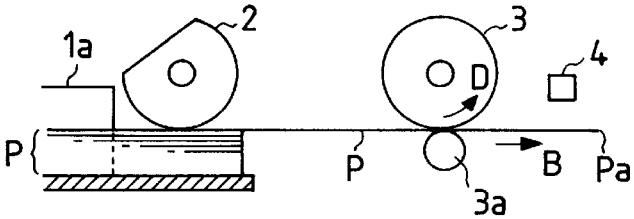
FIG. 6(d) PRIOR ART
Figure 6E:
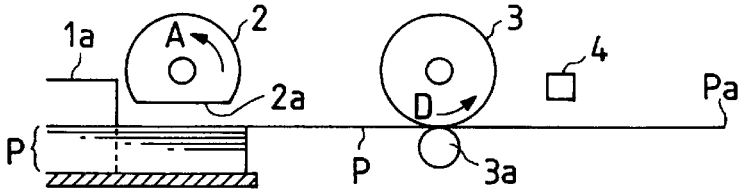
FIG. 6(e) PRIOR ART
Figure 6F:
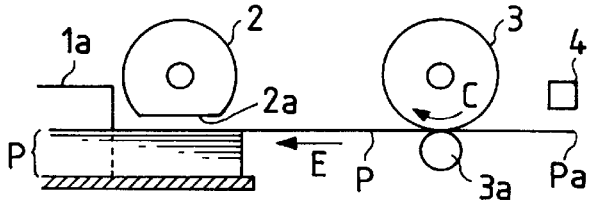
FIG. 6(f) PRIOR ART
Figure 7:
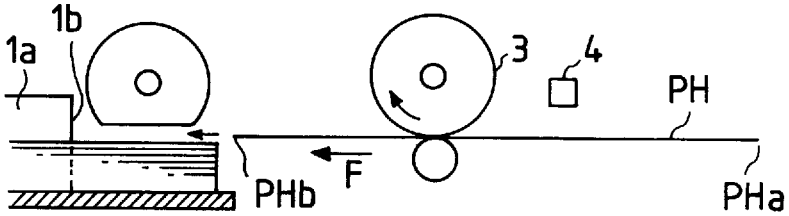
FIG. 7 PRIOR ART
FIG. 7 depicts a step in a prior art method for feeding sheets in a printer.
Figure 8:
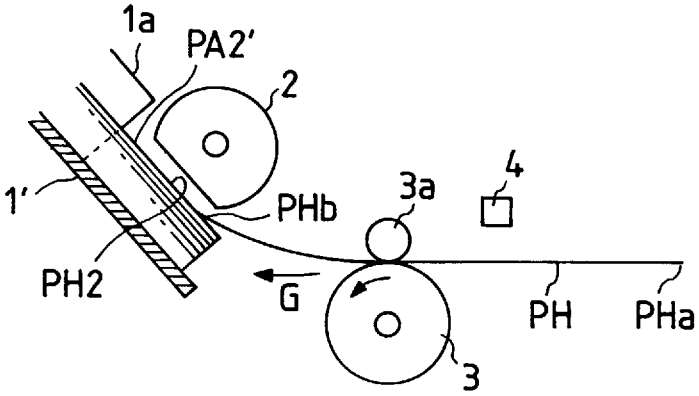
FIG. 8 PRIOR ART
FIG. 8 depicts a step in a prior art feed method.

In the case where a relatively short sheet such as a postcard is set in the automatic sheet feeder, lever 26*a* is moved in the direction of arrow a2 causing contact surface 26*c* to throw switch 28*a*. This condition is detected by detector 28. Control section 200 operates various parts of the printer in the following way. FIGS. 5(*a*)–(*c*) are schematic diagrams showing the operation.

(a) In a standby condition, sheet feed roller 21 is not in operation as shown in FIG. 5(*a*). Straight face 21*a* of sheet feed roller 21 confronts a sheet PH maintained on hopper 22.

(b) Upon output of a sheet feed command signal from control section 200 of the printer, sheet feed roller 21 and sheet forward roller 30 rotate in the directions indicated by arrows R and S, respectively, as shown in FIG. 5(*b*), so that sheet PH is fed toward sheet forward roller 30 in the direction of arrow Q. This sheet feed operation is continued until a head end PHa of sheet PH reaches a predetermined desired position with respect to head 60 as shown in FIG. 5(*c*). Thus, head end PHa of sheet PH is properly positioned with respect to head 60 through this sheet feed operation, and thereafter a print operation begins.

During print operation, the forwarding of sheet PH is performed by sheet forward roller 30 and sheet feed roller 21 until straight face 21*a* opposes sheet PH after completely rotating and sheet feed roller is no longer maintained in contact with sheet PH. Thereafter, sheet PH is forward only by sheet forward roller 30.

According to such print start method, the positioning of sheet PH with respect to head 60 is done without feeding sheet PH in the reverse direction (opposing that indicated by arrow Q in FIG. 5(*b*)), and a print operation is started thereafter. Thus, a tail end PHb of sheet PH does not come in contact with either front edge 23*e* of edge guide 23 or with a sheet PH2 on hopper 22. Therefore, the print operation can begin at a predetermined position. That is, in this method, printing is started by the head 60 on sheet PH even before sheet feed roller 21 releases sheet PH. Therefore, printing can be reliably started at a desired position.

It will thus be seen that the objects set forth above, among those made apparent from the preceding description, are efficiently attained and, since certain changes may be made in carrying out the above method and in the article set forth without departing from the from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A print start method for a printer, said printer including:

providing a print head for printing on a sheet;

a sheet feed roller for forwarding a sheet to be printed upon to said print head, said sheet feed roller having a D-shaped cross section including a straight face and an arcuate face, said sheet feed roller rotating so said arcuate face coming into contact with a sheet to be printed upon to forward said sheet, said sheet feed roller being positioned upstream of said print head in the sheet feed direction; and a sheet forward roller to further forward a sheet to be printed upon to said print head, said sheet forward roller being positioned downstream of said sheet feed roller and upstream of said print head in the paper feed direction, said sheet forward roller being positioned to forward a sheet fed by said sheet feed roller while said sheet feed roller is still maintained in contact with said sheet;

the method comprising the steps of:

determining whether said sheet is a short sheet or one of a relatively long or standard length;

starting a print operation on a sheet by said print head after said sheet feed roller has released a sheet to be printed upon if the sheet being printed upon has a relatively long or standard length; and starting a print operation on a sheet by said print head before said sheet feed roller has released a sheet to be printed upon if the sheet being printed upon has a relatively short length.

2. The method of claim 1, further comprising the steps of:

feeding a relatively long or standard length sheet a predetermined distance in a first direction until said sheet feed roller releases said sheet;

feeding said sheet in a second direction opposite to said first direction to position said sheet with respect to said print head; and feeding said sheet in said first direction while performing a print operation thereon.

3. The method of claim 2, further comprising the steps of:

rotating said sheet forward roller in said first direction to feed said sheet for a distance less than said predetermined distance in said first direction;

stopping the rotation of said sheet feed roller;

rotating said sheet forward roller in a direction opposite to said first direction, thereby bending said sheet;

rotating said sheet forward roller in said first direction until said sheet is no longer bent; and rotating said sheet feed roller in said first direction along with said sheet forward roller prior to the step of forwarding a relatively long or standard length sheet a predetermined distance in a first direction until said sheet feed roller releases said sheet.

4. The method of claim 3, wherein the step of rotating said sheet forward roller in a direction opposite to said first direction, thereby bending said sheet insures that any skew in the direction of the sheet is removed prior to printing.

5. The method of claim 4, wherein said printer includes a sheet tray for holding a plurality of sheets to be printed upon, said sheet tray being positioned at an angle to the paper feed path.

6. The method of claim 1, further comprising the steps of:

forwarding a relatively short sheet a predetermined distance in a first direction before said sheet feed roller releases said sheet;

starting a print operation on said sheet; and feeding said sheet in said first direction until said print operation has been completed.

7. The method of claim 6, wherein said sheet tray is positioned at an angle to the paper feed path.

8. A print start method for a printer, said printer including:

providing a print head for printing on a sheet; and a sheet feed roller for forwarding a sheet to be printed upon to said print head, said sheet feed roller having a D-shaped cross section including a straight face and an arcuate face, said sheet feed roller rotating so said arcuate face coming into contact with a sheet to be printed upon to forward said sheet, said sheet feed roller being positioned upstream of said print head in the sheet feed direction;

the method comprising the steps of:

determining whether said sheet is a short sheet or one of a relatively long or standard length;

starting a print operation on a sheet by said print head after said sheet feed roller has released a sheet to be printed upon if the sheet being printed upon has a relatively long or standard length; and starting a print operation on a sheet by said print head before said sheet feed roller has released a sheet to be printed upon if the sheet being printed upon has a relatively short length.

9. The method of claim 8, further comprising the steps of:

forwarding a relatively short sheet a predetermined distance in a first direction before said sheet feed roller releases said sheet;

starting a print operation on said sheet; and feeding said sheet in said first direction until said print operation has been completed.

10. A printer comprising:

a print head;

a hopper positioned upstream from said print head and adapted to hold a plurality of sheets to be printed upon by said print head;

a paper feed roller positioned downstream from said hopper and upstream from said print head;

a sheet forward roller positioned downstream from said paper feed roller and upstream from said print head for forwarding a sheet from said paper feed roller to said print head;

a lever positioned adjacent said hopper, said lever being selectively positionable between a first position and a second position, said first position corresponding to a short length sheet being held in said hopper, said second position corresponding to a long or standard length sheet being held in said hopper;

a detector operatively coupled to said lever and detecting when a short length sheet is to be fed and outputting a length indication; and a control device receiving said length indication and driving said sheet forward roller in accordance with a first drive sequence said first drive sequence continuing rotation of the sheet feed roller during printing when said length indication indicates a short sheet length, and driving said sheet forward roller in accordance with a second sequence said second drive sequence stopping rotation of the sheet feed roller before the start of printing when said length indication corresponds to a long or standard length sheet.

11. The apparatus of claim 10, further comprising a drive motor driven by said control device.

12. The apparatus of claim 11, wherein said drive motor is selectively coupled with said paper feed roller and said paper forward roller in order to drive said rollers to rotate.

* * * * *